US005402572A

United States Patent [19]

Schulte et al.

[11] Patent Number: 5,402,572

[45] Date of Patent: Apr. 4, 1995

[54] APPARATUS AND METHOD FOR RETROFITTING A METAL ROOF

[75] Inventors: Johnie Schulte, Houston; Leonard F. George, Tomball, both of Tex.

[73] Assignee: NCI Building Systems, L.P., Houston, Tex.

[21] Appl. No.: 174,355

[22] Filed: Dec. 28, 1993

Related U.S. Application Data

[62] Division of Ser. No. 95,845, Jul. 23, 1993.

[51] Int. Cl.[6] ..... B23P 6/00; E04D 1/30

[52] U.S. Cl. ..... 29/897.1; 29/897.32; 29/402.09; 29/402.14; 52/535; 52/540; 52/543; 52/747

[58] Field of Search ..... 52/518, 519, 535, 537, 52/539, 540, 543, 550, 553, 795–798, 630, 746–748, 671; 428/595; 29/897.1, 897.32, 402.09, 402.11, 402.12, 402.13, 402.14, 402.15

[56] References Cited

U.S. PATENT DOCUMENTS

| | | |
|---|---|---|
| 1,616,968 | 2/1927 | Hall . |
| 3,038,573 | 6/1962 | Nuernberger . |
| 3,520,100 | 7/1970 | Webb . |
| 3,667,185 | 6/1972 | Maurer . |
| 3,990,206 | 11/1976 | Reusser . |
| 4,494,343 | 1/1985 | Berry et al. . |
| 4,590,728 | 5/1986 | Stromberg . |
| 4,676,042 | 6/1987 | Bell, III et al. . |
| 4,819,398 | 4/1989 | Dameron . |
| 5,020,295 | 6/1991 | Haines et al. . |

FOREIGN PATENT DOCUMENTS

| | | |
|---|---|---|
| 1178651 | 7/1989 | Japan . |
| 1178652 | 7/1989 | Japan . |
| 1178653 | 7/1989 | Japan . |
| 1178654 | 7/1989 | Japan . |
| 1226966 | 9/1989 | Japan . |
| 1271567 | 10/1989 | Japan . |
| 1271569 | 10/1989 | Japan . |
| 3158554 | 7/1991 | Japan . |
| 420643 | 1/1992 | Japan . |
| 2063961 | 6/1981 | United Kingdom . |

*Primary Examiner*—Tom Hughes
*Attorney, Agent, or Firm*—Gregory W. Carr

[57] ABSTRACT

A method for retrofitting a metal roof formed of overlapping R panels having major ribs and panel flats spaced therebetween includes the steps of removing fasteners disposed along the overlapping margins of adjacent R panels; plugging the holes formed when the fasteners are removed from the R panels; positioning a RETRO R panel having dual-tiered major ribs and panel flats spaced therebetween over the metal roof; aligning the major ribs of the RETRO R panel with major ribs of the underlying R panel; and fastening the major ribs of the RETRO R panel to the major ribs of the underlying R panel. An apparatus for retrofitting a metal roof includes a plurality of dual-tiered major ribs and a plurality of panel flats spaced therebetween, such that when installed over an existing metal roof, the major ribs of the new roof panel are aligned with the major ribs of the underlying roof panel.

9 Claims, 5 Drawing Sheets

APPARATUS AND METHOD FOR RETROFITTING A METAL ROOF

This application is a division of pending application Ser. No. 08/095,845, filed Jul. 23, 1993.

BACKGROUND OF THE INVENTION

The metal building and related metal components industry has produced a common profile for roll-formed exposed metal roofing typically referred to as an "R" panel. R panels typically utilize screws to attach the roof panels to the underlying support structure.

Because R panels have been available for many years, many of the original panels are now deteriorating due to corrosion and wear. Prior art techniques for repairing worn-out R panels include complete roof replacement, in-place coatings such as paint and modified foam coatings, and oversheeting the existing roof using longitudinal secondary members sufficient to support a new roof system.

While the above-described methods have merit, there are also disadvantages associated with each. With complete roof replacement, the building interior may be exposed to adverse weather conditions during the replacement process. In-place coatings are typically not very durable and are subject to corrosion. Oversheeting the existing roof with secondary support members prior to installing a new roof is costly and time-intensive because the installer typically has to remove existing roof fasteners prior to installing the new roof. In addition, because fasteners are typically installed in the roof panel flats, there is a propensity for leakage in these areas. Thus, there is a need for a roof panel configuration and method for retrofitting a metal roof that permits installation of a new roof over a variety of existing roofs without requiring the removal of the existing roof and the addition of a secondary support structure.

SUMMARY OF THE INVENTION

The present invention comprises an apparatus and method for retrofitting a metal roof that overcome the disadvantages associated with the prior art. A method for retrofitting a metal roof formed of overlapping R panels having major ribs and panel flats spaced therebetween includes the steps of removing fasteners disposed along the overlapping margins of adjacent R panels and plugging the holes formed when the fasteners are removed from the R panels. RETRO R panel having major ribs and panel flats spaced therebetween is positioned over the metal roof and the major ribs of the RETRO R panel are aligned in registration with major ribs of the underlying R panel. The major ribs of the RETRO R panel are then fastened to the major ribs of the underlying R panel.

An apparatus for retrofitting a metal roof comprises a plurality of dual-tiered major ribs and a plurality of panel flats spaced therebetween. Each dual-tiered major rib includes a head member and a shoulder member. The head member comprises a flat surface from which two angled surfaces slope downwardly and outwardly. Each shoulder member comprises a pair of flat surfaces from which a pair of angled surfaces slope downwardly and outwardly.

DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figure 1:
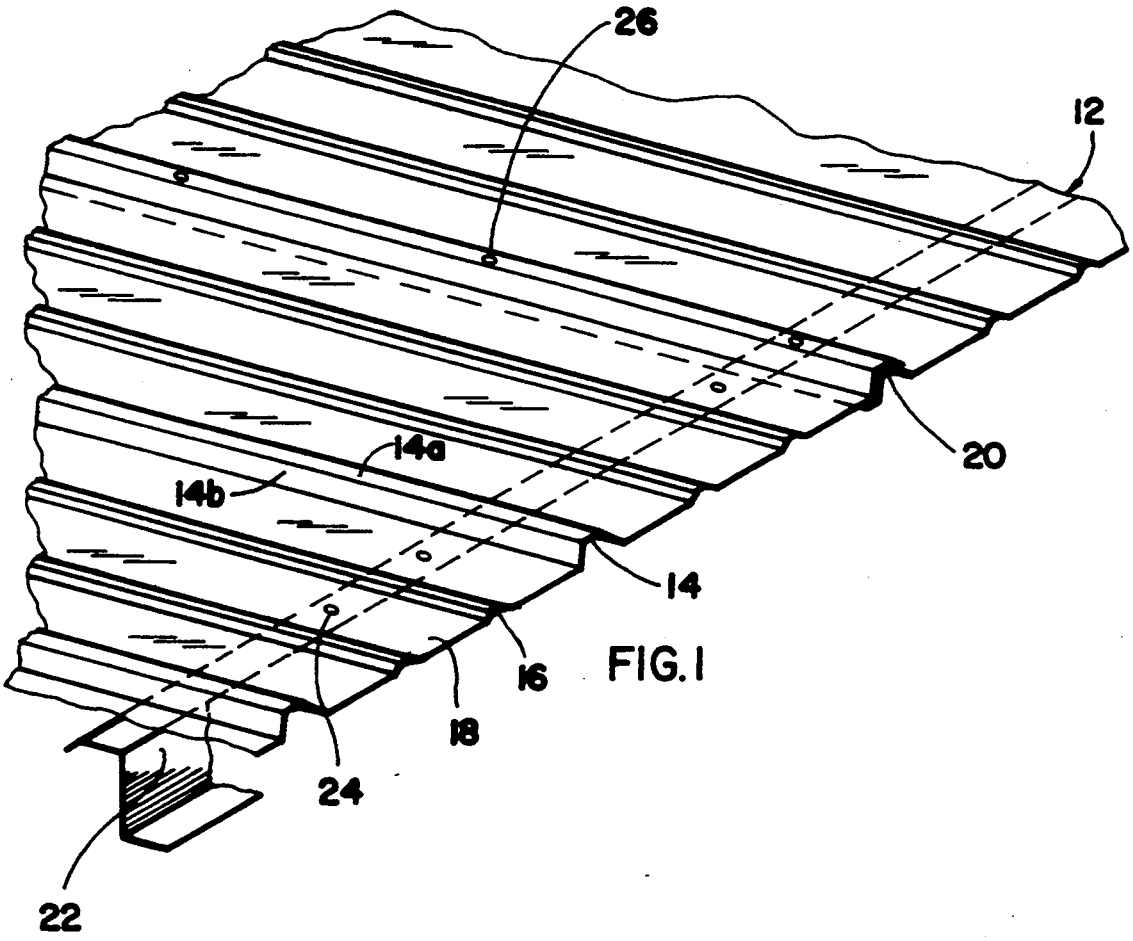
FIG. 1 is a perspective view of a portion of a conventional prior art R roof panel, illustrating the relationship between the R roof panel and the underlying support structure.
Figure 2:
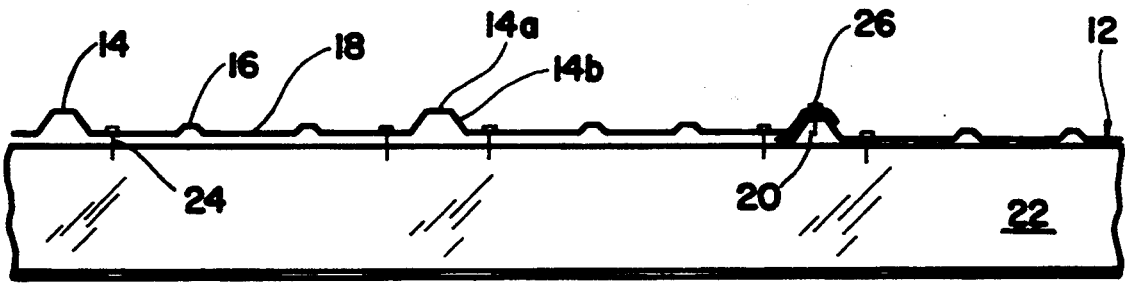
FIG. 2 is a cross-sectional view of the R roof panel of FIG. 1 installed according to prior art methods.

Referring now to the Drawings wherein like reference characters designate like or similar parts throughout the four views, FIG. 1 is a perspective view of a typical R roof panel. FIG. 2 is a cross-sectional view of the R panel of FIG. 1 installed according to prior art methods. Certain fundamental patterns are repeated by most prior art roof panel manufacturers, although placement and dimensions of individual components of the roof panel may vary with a particular manufacturer or product. Typically, an R panel 12 is configured to include a series of major ribs 14 and minor ribs 16 separated by panel flats 18.

Although they may have any configuration, the minor ribs 16 usually have a similar configuration as, but different dimensions than, the major ribs 14. The major ribs 14 are configured with a flat, upper surface 14*a* from which two angled surfaces 14*b* slope downwardly and outwardly from the flat, upper surface 14*a*. Each angled surface 14*b* terminates against an adjacent panel flat 18. Thus, each major rib 14 resembles an inverted, flat-bottomed "V".

The typical height of a major rib 14 is one to one and three-eights inches (1" to 1⅜"). The typical length of the upper surface 14*a* of a major rib 14 is three-fourths to one and one-half inches (¾" to 1½"). Major ribs 14 are commonly spaced approximately one foot (1') apart from center, with one or more minor ribs 16 therebetween.

One edge of an R panel 12 may be positioned to fully or partially overlap a similar edge of an adjacent R panel, thereby forming a lap rib 20. Caulking or sealant tape (not shown) disposed between the plys seals adjacent R panels.

Prior art methods for installing a metal roof require that a secondary support member 22 be secured to the primary frames (not shown) prior to installation of the R panels 12. The secondary support member 22 may be zees, cees, channel or bar joists or hot roll beams. This secondary support member 22 is positioned perpendicular to the length of the major and minor ribs. Self-driller or self-tapper fasteners 24, such as structural screw inserts or some other form of fastener, are installed adjacent to the panel ribs 14 to secure the R panel 12 to the secondary support member 22. Fasteners 26, such as screws or rivets, are inserted into the flat, upper surfaces of overlapping adjacent R panels to secure, and prevent shifting of, the panels. The fasteners 26 do not penetrate the secondary support member 22.

Figure 3A:
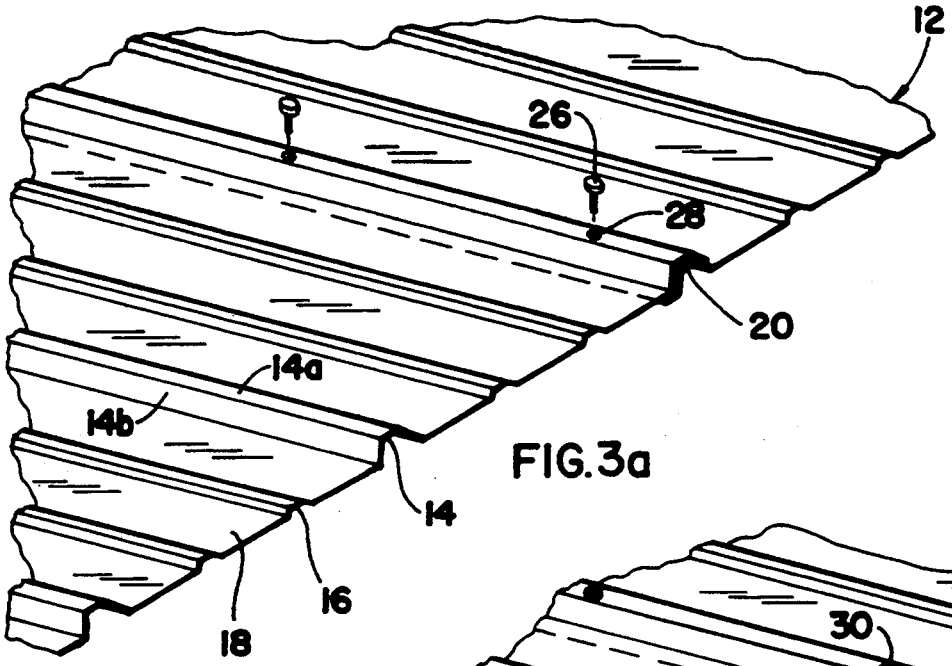
FIGS. 3*a* through 3*f* are perspective views of the steps comprising the method for retrofitting a metal roof using a novel RETRO R roof panel according to the present invention.
Figure 3B:
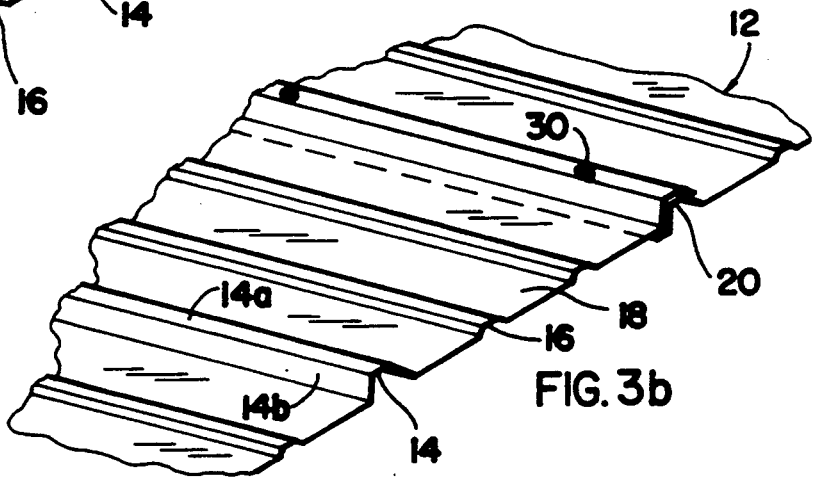

Turning now to FIGS. 3*a* through 3*f*, there are shown perspective views of the steps comprising the method for retrofitting a metal roof according to the present invention using a RETRO R panel. First, previously installed screws 26 are removed from holes 28 in the flat, upper surface of the lap rib 20 formed by the overlapping of two adjacent R panels 12. Next, conventional pop rivets 30 are inserted into the holes 28 (not shown) created by the fasteners 26 in the flat, upper surface of the lap rib 20. FIG. 3*b* illustrates the pop rivets' position following their insertion into the holes 28.

Figure 3C:
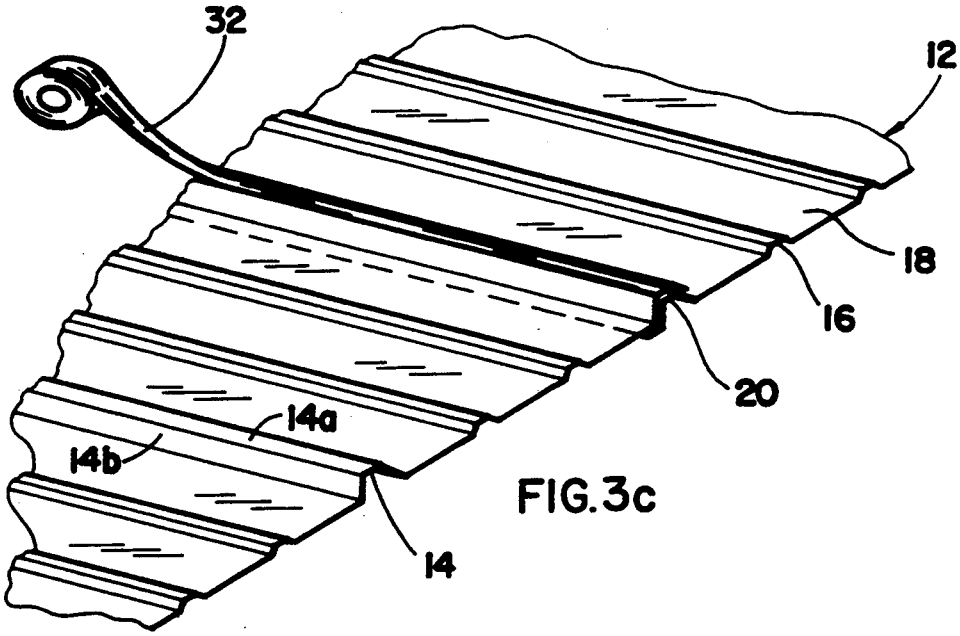

As illustrated in FIG. 3*c*, sealant tape 32 may be used to cover the pop rivet-filled holes in the lap rib 20. Preferably, the sealant tape 32 is positioned along the length of each lap rib 20. This step, although desirable, is not required. The sealant tape 32 functions to deter or prevent water leaks around the holes 28 into the building and to cushion the contact between the pop rivets 30 and the RETRO R panel.

Figure 3D:
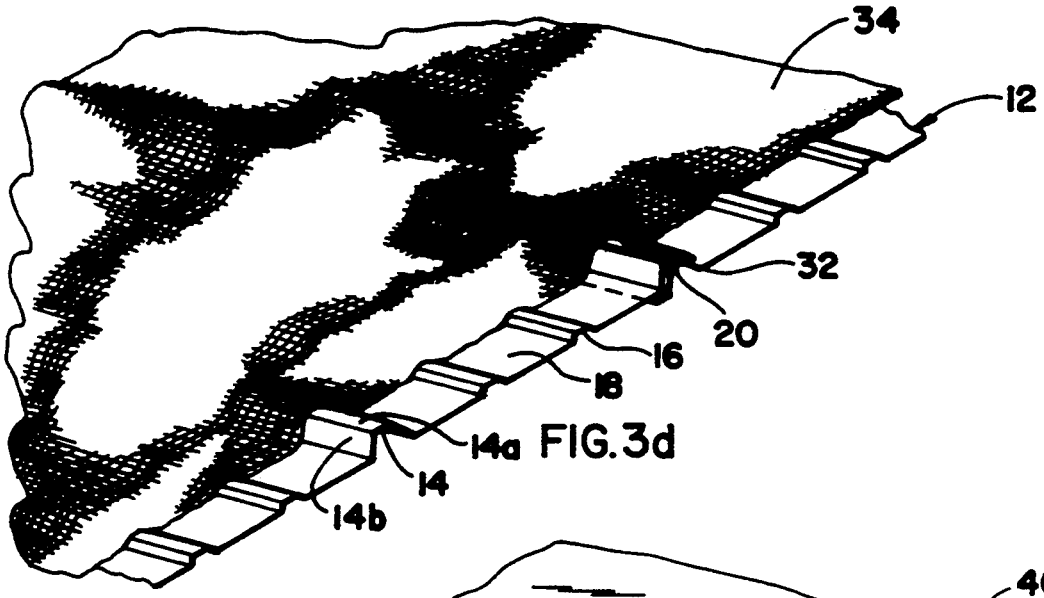

Referring now to FIG. 3*d*, conventional felt paper or closed cell foam blanket 34 may be draped over the existing R panel 12. Fifteen weight felt paper is preferred. In the alternative, high-density polyethylene foam may be used. The felt paper or foam sheeting 34 substantially covers the R panel 12, but is not attached thereto. The felt paper or foam sheeting 34 assists in deterring or preventing condensation from forming between the existing panel 12 and the RETRO R panel 40.

Figure 3E:
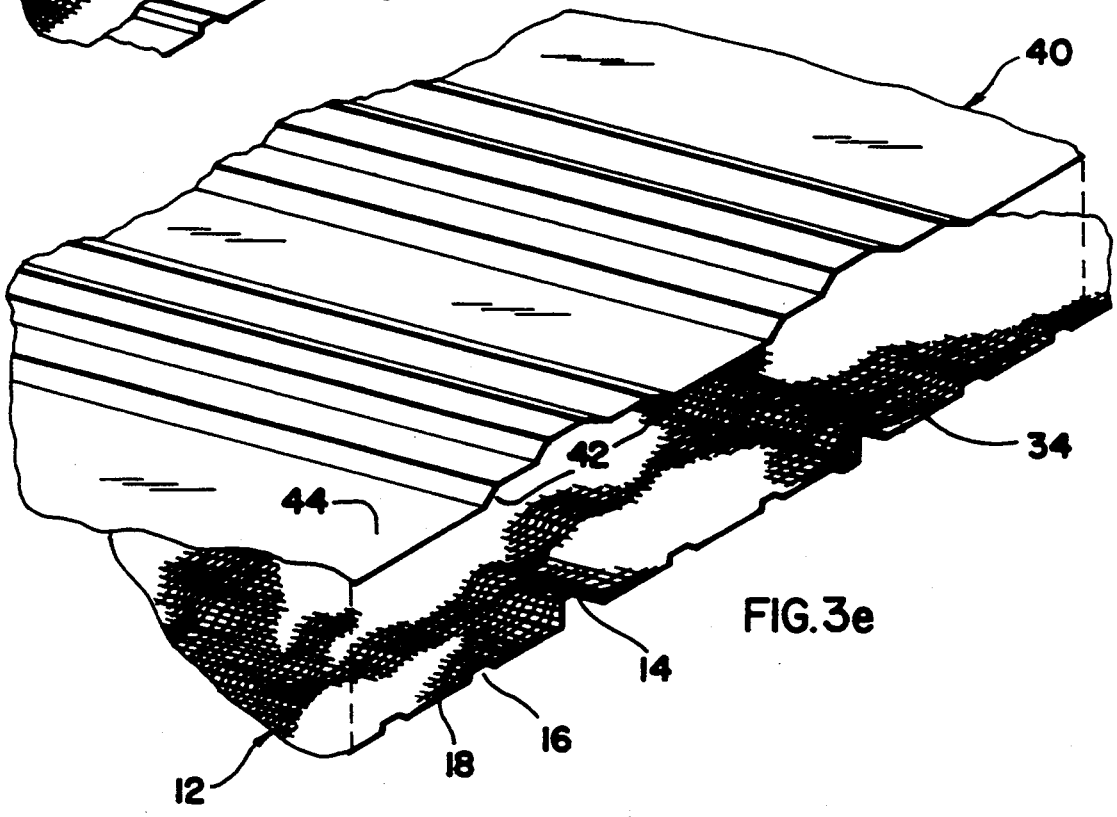

Turning to FIG. 3*e*, a novel RETRO R panel 40 according to the present invention is positioned over the felt paper-covered R panel 12. The RETRO R panel 40 comprises a series of dual-tiered major ribs 42 separated by panel flats 44.

As illustrated in FIG. 3*e*, each major rib 42 of the RETRO R panel comprises a dual-tiered structure. The first tier or head member comprises a single flat surface **42*a* and two angled surfaces 42*b* which slope downwardly and outwardly from the flat, upper surface 42*a* of major rib 42. Each angled surface 42*b*** of the head member terminates against a second tier or shoulder member.

The shoulder member of the major rib 42 comprises two flat surfaces **42*c* and two angled surfaces 42*d* which slope downwardly and outwardly from flat surfaces 42*c*. The two flat surfaces of the shoulder member are substantially parallel to the flat surface 42*a* of the head member. Each angled surface 42*c* of the shoulder member terminates against an adjacent panel flat 44. The angle of slope of angled surfaces 42*b* and 42*d*** may be varied as desired.

Preferably, the flat surface **42*a* of the major rib 42 is approximately one and one-half inches (1½") long and has a height of one-half inch (½") from the horizontal plane of the shoulder member. The two angled surfaces 42*b*** of the head member are each eleven-sixteenth inches (11/16") long.

Regarding the shoulder member, it is preferable that each flat surface **42*c* is approximately one and five-eights inches (1⅝") long and has a height of five-eighths inches (⅝") from the horizontal plane of the adjacent panel flats. Each angled surface 42*d*** of the shoulder member is approximately seven-eights inches (⅞") long.

The major ribs 42 of the RETRO R panel are spaced apart to ensure that the RETRO R panel will cover the existing R panel and that there will be proper alignment of the upper surface of the major ribs of the new roof panel with the upper surface of the major ribs of the existing roof panel. In most applications, this will require a spacing of about one foot (1'). RETRO R panel is configured to have the same inter-major rib distance as the underlying roof panels to ensure proper alignment of the upper surfaces of the respective major ribs.

As illustrated in FIG. 3*e*, each "RETRO R" panel is formed as one continuous panel that may be cut into individual sections, as appropirate. The configuration of the RETRO R panel 40 is substantially different than the configuration of the prior art R panel 12. The RETRO R panel 40 has no minor ribs. The panel flats 44 of the RETRO R panel 40 are substantially longer than the corresponding panel flats 18 of the prior art R panel. Each major rib 42 of the RETRO R panel 40 is dual-tiered, with three flat surfaces and two pairs of angled surfaces. The prior art R panel 12 has one flat surface and a single pair of angled surfaces. The unique configuration of the RETRO R panel's major ribs 42 and panel flats 44 functions to permit installation of the RETRO R panel 40 over many different configurations of prior art R panels. The two-tiered shape of the RETRO R major rib 42 is configured so that the original roof fasteners (24 in FIGS. 1 and 2) can remain in place without interfering with the installation of the RETRO R panel 40.

As installed, the general configuration of the RETRO R panel 40 will not necessarily correspond to or follow the shape of the underlying R panel 12, except at the upper surfaces of the major ribs. The panel flats 44 of the RETRO R panel 40 may or may not make physical contact with the upper surfaces of the minor ribs 16 of the underlying R panel 12 when installed. The RETRO R panel 40 will define a clearance 46, which will accommodate the top of the structural fasteners 24 projecting above R panel 12, thereby obviating the removal of the fasteners prior to installing the RETRO R panel 40.

Figure 3F:
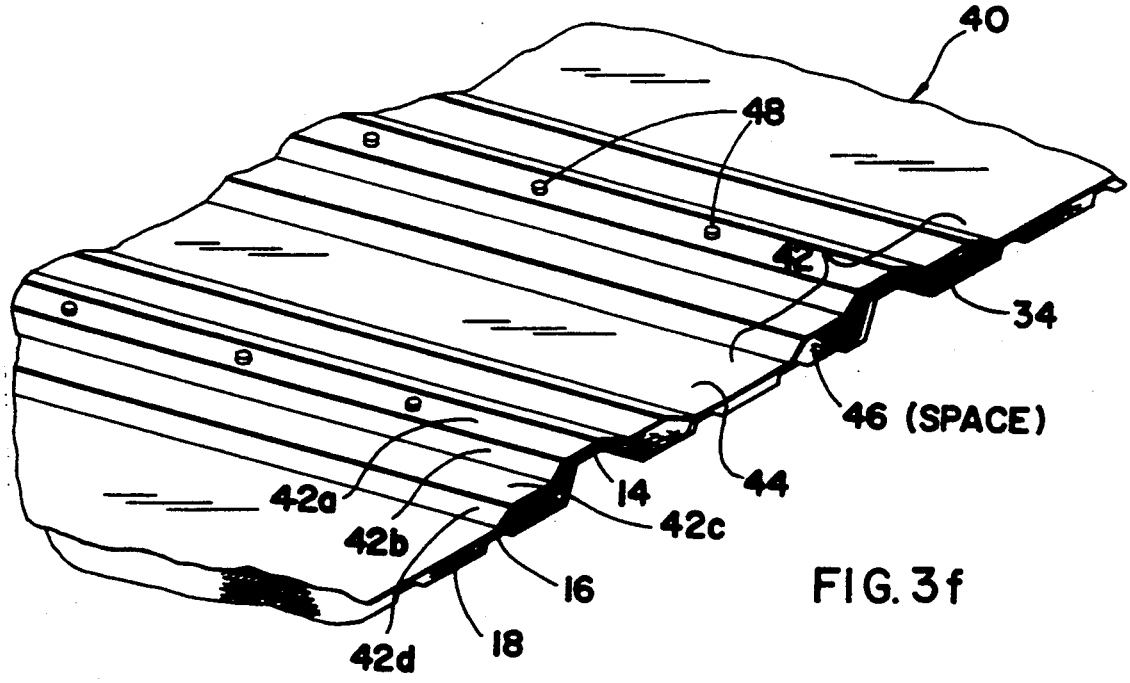

Finally, as illustrated in FIG. 3*f*, structural fasteners 48 are then inserted into the flat, upper surface **42*a* of major rib 42 to secure the RETRO R panel 40 to the underlying R panel 12. The structural fasteners 48 extend downwardly through the flat, upper surface 14*a* of the underlying R panel's major rib 14. No additional structrual fasteners are required to secure the RETRO R panel 40 to the underlying R panel 12. Felt paper 34** or foam sheeting separates and insulates the two roof panels.

Figure 4:
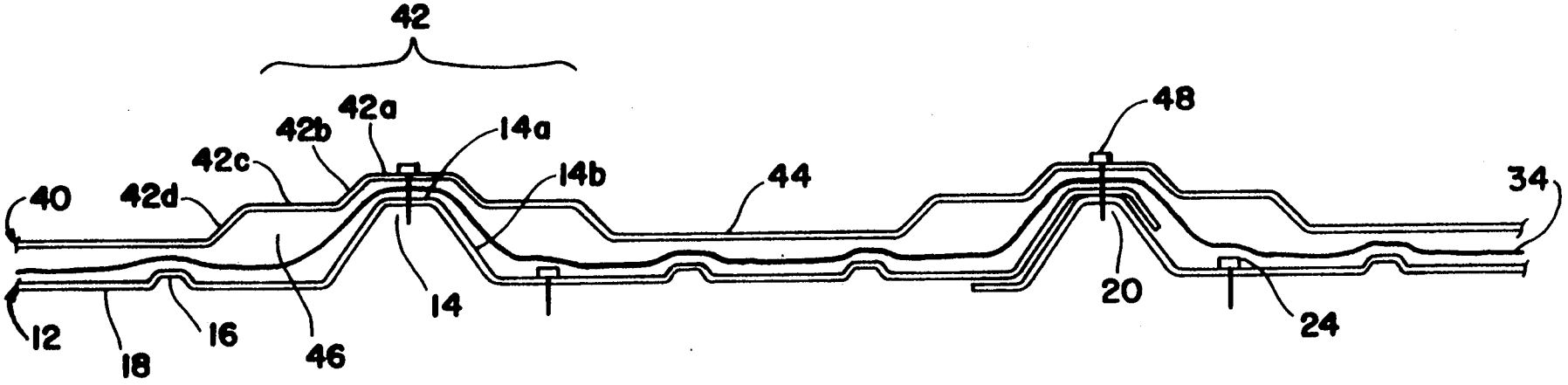
FIG. 4 is a cross-sectional view of an installed RETRO R roof panel according to the present invention, illustrating the relationship between the new and existing roofs.

FIG. 4 is a cross-sectional view of a RETRO R panel 40 installed according to the present invention, illustrating the relationship between the underlying R panel 12 and the RETRO R panel 40. The underlying R panel 12 is configured with a series of major ribs 14 and minor ribs 16 separated by panel flats 18. Structural fasteners 24 disposed in the panel flats 18 secure the R panel to the underlying structure. Felt paper or foam sheeting 34 separates the R panel 12 and the RETRO R panel 40.

RETRO R panel 40 includes a plurality of dual-tiered, major ribs 42 separated by panel flats 44. A clearance 46 defined by the configuration of the RETRO R panel 40 is provided between the preexisting and newly applied roof panels. Structural fasteners 48 are inserted through surface **42*a* of major rib 42 of the RETRO R panel 40 and surface 14*a* of the R panel 12** to attach the two roofs.

The RETRO R panel of the present invention has several advantages over the prior art R panels, both in terms of configuration and method of installation. The configuration of the RETRO R panel has sufficient major rib base width to permit the RETRO R panel to cover the typical structural fasteners in place in an R panel, thereby eliminating the need to remove these fasteners prior to retrofitting. The novel RETRO R panel is configured to overlay most of the R panel major ribs presently in use today. The RETRO R panel is configured to have substantially the same inter-major rib distance as conventional R panels to ensure that the RETRO R panel may be aligned properly when installed over the underlying prior art roof. The RETRO R panel is configured such that the panel flats are vertically positioned slightly above the minor ribs of most conventional R panels.

Installation of the RETRO R panel has advantages over prior art installation methods because installation of the RETRO R panel can be accomplished without exposing the building interior to adverse weather conditions. Specifically, the original roof panels (common R panels) may be left in place during the retrofitting procedure. In addition, installation is accomplished without the need to install any secondary support members on top of the existing roof panels. Moreover, because there is no need to remove the existing fasteners of the original roof panel prior to installation of the RETRO R panel, installation is faster, less costly and the original structural fasteners 24 can be relied upon for securing the original panel to the secondary support members.

Finally, with an installed RETRO R panel, there are no fasteners through the lowermost surface of the roof panel, other than at the panel ends. Terminating ends of adjacent "RETRO R" panels overlap each other and are fastened together at the panel ends via fasteners (not shown). The fastened, overlapping terminating ends of adjacent "RETRO R" panels are not secured to the underlying R panel or to the sub-structure. All attachments of the RETRO R panel to the existing roof are made through the upper surface of the major rib. Thus, the propensity for water leaks is greatly reduced by eliminating the fasteners typically installed in the panel flats of prior art roof panels.

Although a preferred embodiment of the present invention has been illustrated in the accompanying Drawings and described in the foregoing Detailed Description, it will be understood that the invention is not limited to the embodiments disclosed, but is capable of numerous rearrangement, modifications, and substitutions of parts and elements without departing from the spirit of the invention.

We claim:

1. A method for retrofitting a metal roof formed of R panels having overlapping ends, a plurality of single-tiered major ribs, minor ribs and panel flats, a respective panel flat being spaced between respective major and minor ribs and defining a predetermined inter-major ribs distance, comprising the steps of:

(a) removing fasteners disposed along the overlapping ends of adjacent R panels, thereby exposing holes formed when said fasteners were inserted into the R panels;

(b) plugging the holes exposed when the fasteners in step (a) are removed from the R panels;

(c) positioning a "RETRO R" panel over the metal roof, each "RETRO R" panel having dual-tiered major ribs and panel flats, a respective panel flat being spaced between respective major ribs and defining a predetermined inter-major ribs distance;

(d) aligning the dual-tiered major ribs of the "RETRO R" panel in registration with the single-tiered major ribs of the underlying R panel; and (e) fastening the dual-tiered major ribs of the "RETRO R" panel to the single-tiered major ribs of the underlying R panel.

2. The method of claim 1 wherein the holes are plugged with pop rivets.

3. The method of claim 1 further comprising the step of applying sealant tape over the plugged holes.

4. The method of claim 1 further comprising the step of applying sealant tape over the overlapping margins of adjacent R panels.

5. The method of claim 1 further comprising the step of disposing a layer of felt paper over the metal roof after plugging the holes.

6. The method of claim 5 wherein the felt paper is approximately fifteen weight.

7. The method of claim 1 further comprising the step of disposing a layer of foam sheeting over the metal roof after plugging the holes.

8. The method of claim 7 wherein the foam sheeting is high-density polyethylene foam.

9. A method for retrofitting a metal roof formed of R panels having overlapping ends, a plurality of single-tiered major ribs, minor ribs and panel flats, a respective panel flat being spaced between respective major and minor ribs and defining a predetermined inter-major ribs distance, comprising the steps of:

(a) removing structural fasteners disposed along the overlapping ends of adjacent R panels, thereby exposing holes formed when said structural fasteners were inserted into the R panels;

(b) plugging the holes exposed when the fasteners in step (a) are removed from the R panels;

(c) applying sealant tape over the overlapping margins of adjacent R panels;

(d) disposing a layer of felt paper or foam sheeting over the metal roof;

(e) positioning a "RETRO R" panel over the metal roof, each "RETRO R" panel having dual-tiered major ribs and panel flats, a respective panel flat being spaced between respective major ribs and defining a predetermined inter-major ribs distance;

(f) aligning the dual-tiered major ribs of the "RETRO R" panel in registration with the single-tiered major ribs of the underlying R panel; and (g) fastening the dual-tiered major ribs of the "RETRO R" panel to the single-tiered major ribs of the underlying R panel.

* * * * *